US011987866B2

(12) United States Patent
Yang et al.

(10) Patent No.: US 11,987,866 B2
(45) Date of Patent: May 21, 2024

(54) ALLOY AND FABRICATION THEREOF

(71) Applicant: City University of Hong Kong, Kowloon (HK)

(72) Inventors: Yong Yang, Kowloon (HK); Hang Wang, Kowloon (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 17/871,011

(22) Filed: Jul. 22, 2022

(65) Prior Publication Data

US 2024/0026502 A1 Jan. 25, 2024

(51) Int. Cl.
*C22C 30/00* (2006.01)
*C21D 9/00* (2006.01)

(52) U.S. Cl.
CPC ..... *C22C 30/00* (2013.01); *C21D 9/00* (2013.01)

(58) Field of Classification Search
CPC .. C22C 45/10; C22C 1/00; C22C 1/03; C22C 16/00; C22C 1/0458; C22C 19/07; C22C 45/04; B22D 25/00; Y10T 428/12986; Y10T 428/12; Y10T 428/12389; Y10T 428/12431; Y10T 428/12493; Y10T 428/12535; Y10T 428/12771; Y10T 428/12806; Y10T 428/12854; Y10T 428/12951; Y10T 428/24777; Y10T 428/31678
See application file for complete search history.

(56) References Cited

FOREIGN PATENT DOCUMENTS

CN 103334065 A * 10/2013
CN 107234196 A * 10/2017 ..... B21J 5/002
JP 2005008928 A * 1/2005

OTHER PUBLICATIONS

NPL: on-line translation of JP-2005008928-A, Jan. 2005 (Year: 2005).*
NPL: on-line translation of CN-103334065-A, Oct. 2013 (Year: 2013).*
NPL: on-line translation of CN-107234196-A, Oct. 2017 (Year: 2017).*

* cited by examiner

*Primary Examiner* — Jie Yang
(74) *Attorney, Agent, or Firm* — Renner, Kenner, Greive, Bobak, Taylor & Weber

(57) ABSTRACT

An alloy consisting of titanium, zirconium, cobalt, and nickel, and its fabrication.

11 Claims, 3 Drawing Sheets

ALLOY AND FABRICATION THEREOF

TECHNICAL FIELD

The invention relates to an alloy and its fabrication.

BACKGROUND

The elastic modulus of most metals decreases when the temperature increases as a result of thermal expansion. In contrast, Elinvar alloys retain their elastic modulus over a very wide range of temperature changes. Due to their promising properties aside of the possible structural simplicity, chemically complex alloys, including high entropy alloys, have recently attracted tremendous attention in development of Elinvar alloys.

SUMMARY

In a first aspect, there is provided an alloy having a formula of $(TiZr)_{100-x}(CoNi)_x$, wherein $40 \leq x \leq 60$ in atomic percentage.

Optionally, the atomic percentage of at least one or each of Ti, Zr, Co, and Ni is about 20% to about 30%.

Optionally, the atomic percentages of Ti and Zr are substantially the same. The atomic percentages of Co and Ni may be substantially the same.

Optionally, the alloy essentially consists of, in atomic percentage, about 20% to about 30% of Ti, about 20% to about 30% of Zr, about 20% to about 30% of Co, and about 20% to about 30% of Ni. The alloy may further include unavoidable impurities.

Optionally, the alloy is an Elinvar alloy having a relatively constant elastic modulus with varied temperature, e.g., in the range of about 250 K to about 850 K.

Optionally, the alloy comprises a complex intermetallic phase.

Optionally, the alloy is a substantially equiatomic alloy. It may selectively exhibit a random structure in response to being quenched and an ordered structure in response to being annealed. The random structure may be a single-phase structure. Each of the random structure and the ordered structure may have a body-centered cubic structure. Preferably, the ordered body-centered cubic structure is a B2 structure.

Optionally, the alloy exhibits the B2 structure after being annealed at about 1000° C. for about 24 hours.

In a second aspect, there is provided a method of fabricating an alloy. The alloy may or may not be the alloy in the first aspect. The method may comprise melting a mixture essentially consisting of, in atomic percentage, about 20% to about 30% of Ti, about 20% to about 30% of Zr, about 20% to about 30% of Co, and about 20% to about 30% of Ni; and quenching the melted mixture to form the alloy with a single-phase random body-centered cubic structure. The method may further comprise annealing the alloy at about 1000° C. for about 24 hours to result in an ordered B2 structure.

Optionally, the melting is performed in an arc furnace under an inert atmosphere, e.g., an argon atmosphere.

Preferably, the inert atmosphere is provided with a getter material, e.g., a titanium getter material.

In a third aspect, there is provided a device manufactured using an alloy. The alloy may or may not be the alloy in the first aspect or the alloy fabricated using the method in the second aspect. The device may be an additive-manufactured device. The device may be any device for use in structural and functional applications, including transportation, electronic, chemical and energy generations technologies. Preferably, the device is a high-precision device that operates over a wide temperature range, an outdoor equipment used in extreme environments, a mechanical chronometer used in aerospace or space mission, etc.

In a fourth aspect, there is provided a method of manufacturing a device having an alloy. The device may or may not be the device in the third aspect. The alloy may or may not be the alloy in the first aspect or the alloy fabricated using the method in the second aspect. The method may include the step of additive manufacturing the alloy.

BRIEF DESCRIPTION OF THE DRAWINGS

Embodiments of the invention will now be described, by way of example, with reference to the accompanying drawings, in which.

DETAILED DESCRIPTION

Figure 1B:
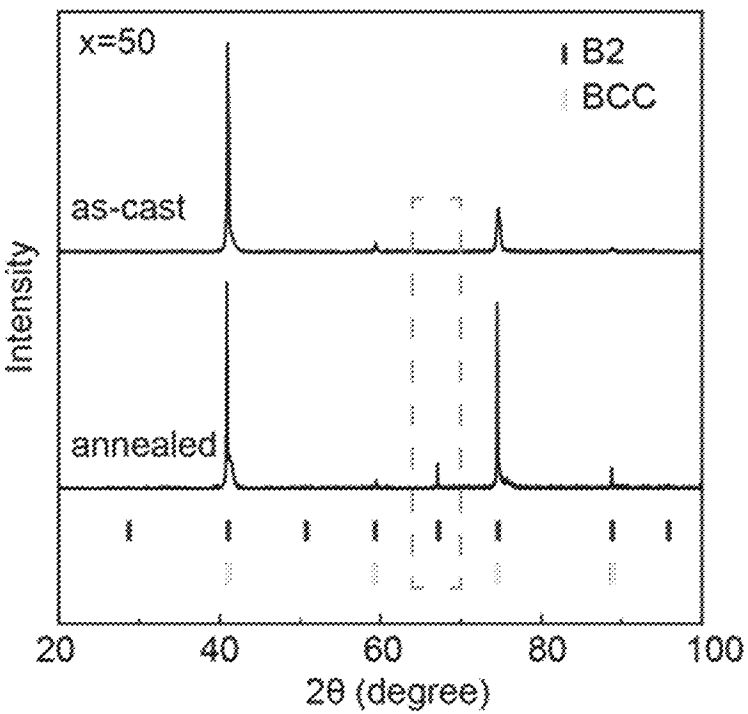
FIG. 1B shows X-ray diffraction (XRD) patterns of TiZrCoNi in the as-cast state and after being annealed at 1000° C. for 24 hours, respectively.

Unless otherwise specifically provided, all tests herein are conducted at standard conditions which include a room and testing temperature of 25° C., sea level (1 atm.) pressure, pH 7, and all measurements are made in metric units. Furthermore, all percentages, ratios, etc. herein are by weight, unless specifically indicated otherwise. It is understood that unless otherwise specifically noted, the materials, compounds, chemicals, etc. described herein are typically commodity items and/or industry-standard items available from a variety of suppliers worldwide.

Also, it is to be understood that the phraseology and terminology used herein is for the purpose of description and should not be regarded as limiting. Terms of degree, such as "substantially" or "about" are understood by those of ordinary skill to refer to reasonable ranges outside of the given value, for example, general tolerances associated with manufacturing, assembly, testing, and use of the described embodiments.

As used herein, "high-entropy alloys (HEAs)" are defined as multicomponent alloys containing four or more constituent elements each with a concentration about 20 atomic % to about 30 atomic %.

As used herein, "Elinvar alloys" are defined as alloys that exhibit the Elinvar effect, i.e., the elastic modulus thereof is relatively constant with varied temperature.

In one embodiment, a series of high-entropy alloys having a formula of $(TiZr)_{100-x}(CoNi)_x$, where $40 \leq x \leq 60$ in atomic percentage is obtained by tuning the chemical compositions of titanium (Ti), zirconium (Zr), cobalt (Co) and nickel (Ni) which in turn systematically changes the configurational entropy. As will be appreciated by persons skilled in the art, Ti and Zr are relatively larger atoms while Co and Ni are relatively smaller atoms. It is believed that these atoms would together constitute an alloy with high lattice distortion, which may raise the energy barrier against dislocation movement, giving rise to solid solution strengthening in the alloy. The lattice distortion may also cause sluggish atom diffusion, thereby promoting the thermodynamic stability of the alloy.

The alloy may be an Elinvar alloy with its elastic modulus kept relatively constant with temperature changes in the range of about 250 K to 850 K, about 275 K to about 825 K, or about 300 K to about 800 K. The alloy may be present in any form (e.g., sheet, wire, mesh, etc.) and may be processed and used to manufacture products (e.g., with additive manufacturing). For example, the alloy may be used to manufacture high-precision devices that operate over a wide temperature range, outdoor equipment used in extreme environments, mechanical chronometers used in aerospace or space mission, etc. that generally require constant elastic modulus over a wide temperature range.

The alloy may selectively exhibit a random structure and an ordered structure, e.g., in response to being quenched and being annealed, respectively. The random structure may be a single-phase structure and may have a body-centered cubic (BCC) structure. The ordered structure may also have a body-centered cubic structure, e.g., a B2 structure with excellent tensile or compressive ductility as well as low thermal conductivity. Due to its BCC structure, the alloy may also be used to manufacture devices in various structural and functional applications, including transportation, electronic, chemical and energy generations technologies.

The quenching may be the last step of the fabrication of the alloy, e.g., where molten alloy is put into a water-cooled mold before the resultant alloy is formed. In other words, the as-cast state of the alloy may have a random structure. The annealing may take place, e.g., at about 800° C. to about 1200° C., about 900° C. to about 1100° C., or about 1000° C., for about 1 hour to about 48 hours, about 12 hours to about 36 hours, or about 24 hours.

The concentration of each element may be about 5 atomic % to about 45 atomic %, about 10 atomic % to about 40 atomic %, or about 20 atomic % to about 30 atomic %. For example, the alloy may be essentially consisting of about 20 atomic % to about 30 atomic % of each of Ti, Zr, Co, and Ni. As used herein, "essentially consisting of" means, except the listed four elements, the alloy may further include unavoidable impurities. The modifier "about" associated with an atomic percentage means the given value±1%.

The atomic percentages of Ti and Zr may be substantially the same, for example, each being about 20%. Similarly, the atomic percentages of Co and Ni may be substantially the same, for example, each being about 30%. Preferably, in the alloy, the atomic percentages for Ti and Zr are the same, and the atomic percentages for Co and Ni are the same. Alternatively, the concentration of each element within the pair of Ti and Zr and the pair of Co and Ni may be different. The concentration of each element between the pairs may also be different. In other words, the alloy may be a non-equiatomic alloy. Non-equiatomic alloys may comprise a complex intermetallic phase in the as-cast state (e.g., after being quenched), including but not limited to, the C14 Laves phase and the C15 Laves phase.

In one embodiment, the alloy is a substantially equiatomic alloy, i.e., having a formula of TiZrCoNi. As used herein, "substantially equiatomic" means the alloy is equiatomic when the unavoidable impurities are omitted. In contrast to non-equiatomic alloys, TiZrCoNi exhibits a single-phase random BCC structure in the as-cast state, indicating a strong entropy stabilization effect of TiZrCoNi. Furthermore, TiZrCoNi possesses an ordered B2 structure after being annealed at about 1000° C. for about 24 hours.

In one embodiment, the alloy having a formula of $(TiZr)_{100-x}(CoNi)_x$, where $40 \leq x \leq 60$ in atomic percentage (which may be equiatomic or non-equiatomic) is fabricated by melting a mixture essentially consisting of raw materials of each constituting element, quenching the melted mixture to form the alloy, and optionally annealing the alloy. For example, the mixture may consist of about 5 atomic % to about 45 atomic %, about 10 atomic % to about 40 atomic %, or about 20 atomic % to about 30 atomic % of each of Ti, Zr, Co, and Ni. The raw materials may be in the form of metal powders, metal wires, etc. The raw materials may have a purity of above 95%, above 97%, or above 99%, and preferably above 99.9%. The raw materials may have similar or different particle sizes or morphologies.

The step of melting may be performed in a furnace, e.g., an arc furnace, filled with an inert atmosphere. The inert atmosphere may contain argon, carbon dioxide, a mixture of carbon dioxide and argon, or a mixture of nitrogen and carbon dioxide, that is previously pumped at below $10\times10^{-4}$ Pa, below $9\times10^{-4}$ Pa, or below $8\times10^{-4}$ Pa. Preferably, the inert atmosphere is provided with a getter material, e.g., Ti ingots, Ti discs, etc., to remove impurities from the atmosphere.

The step of melting may be repeated for 10 times, 8 times, or 5 times to ensure the chemical homogeneity. Additionally, the resultant ingot after each melting step may be flipped before subjecting to remelting. The liquid alloy may then be cast into a desired shape with the use of a mold, e.g., a water-cooled copper mold, under a cooling rate of about $10^2$ K/s.

The step of annealing may be performed at about 800° C. to about 1200° C., about 900° C. to about 1100° C., or about 1000° C., for about 1 hour to about 48 hours, about 12 hours to about 36 hours, or about 24 hours. In one embodiment where the alloy exhibits a single-phase random body-centered cubic structure after being quenched, after being annealed at about 1000° C. for about 24 hours, the alloy is transformed into an ordered B2 structure.

Hereinafter, the present invention is described more specifically by way of examples, but the present invention is not limited thereto.

Preparation of $(TiZr)_{100-x}(CoNi)_x$ Alloys

Five separate $(TiZr)_{100-x}(CoNi)_x$ alloys were prepared. For each alloy, (in the form of particles, purity>99.9%) for each constituting element were provided with the amounts shown in Table 1. These raw materials were then melted in an arc furnace filled with a Ti-guttered argon atmosphere that was previously pumped below $8\times10^{-4}$ Pa. The formed ingots were then flipped and remelted for five times to form a liquid alloy. After that, the liquid alloy was dropped into a water-cooled copper mold, before the resultant alloy was formed. The amounts, in atomic percentages, of each element in the resultant alloys are shown in Table 2.

TABLE 1

Amounts of raw materials for the alloys.

| Alloy | Mass of Ti (g) | Mass of Zr (g) | Mass of Co (g) | Mass of Ni (g) |
|---|---|---|---|---|
| $(TiZr)_{40}(CoNi)_{60}$ | 3.7926 | 7.2278 | 7.0041 | 6.9756 |
| $(TiZr)_{45}(CoNi)_{55}$ | 4.2307 | 8.0627 | 6.3662 | 6.3403 |
| $(TiZr)_{50}(CoNi)_{50}$ | 4.6614 | 8.8837 | 5.7391 | 5.7157 |
| $(TiZr)_{55}(CoNi)_{45}$ | 5.0851 | 9.6910 | 5.1224 | 5.1015 |
| $(TiZr)_{60}(CoNi)_{40}$ | 5.5017 | 10.4851 | 4.5158 | 4.4974 |

TABLE 2

| Amounts of each element in the alloys. | | | | |
|---|---|---|---|---|
| Alloy | atomic % of Ti | atomic % of Zr | atomic % of Co | atomic % of Ni |
| $(TiZr)_{40}(CoNi)_{60}$ | 20 | 20 | 30 | 30 |
| $(TiZr)_{45}(CoNi)_{55}$ | 22.5 | 22.5 | 27.5 | 27.5 |
| $(TiZr)_{50}(CoNi)_{50}$ | 25 | 25 | 25 | 25 |
| $(TiZr)_{55}(CoNi)_{45}$ | 27.5 | 27.5 | 22.5 | 22.5 |
| $(TiZr)_{60}(CoNi)_{40}$ | 30 | 30 | 20 | 20 |

Characterization

For each alloy, the crystalline structure was characterized using the X-ray diffraction technique. One sample for each alloy (about 1 g, in the form of bulk) was first prepared. The samples were then mechanically ground and polished to a mirror finish before being scanned from 20° to 90° at 4° per min with Rigaku Smartlab using a Cu target and an X-ray wavelength of 1.54 Å.

Figure 1A:
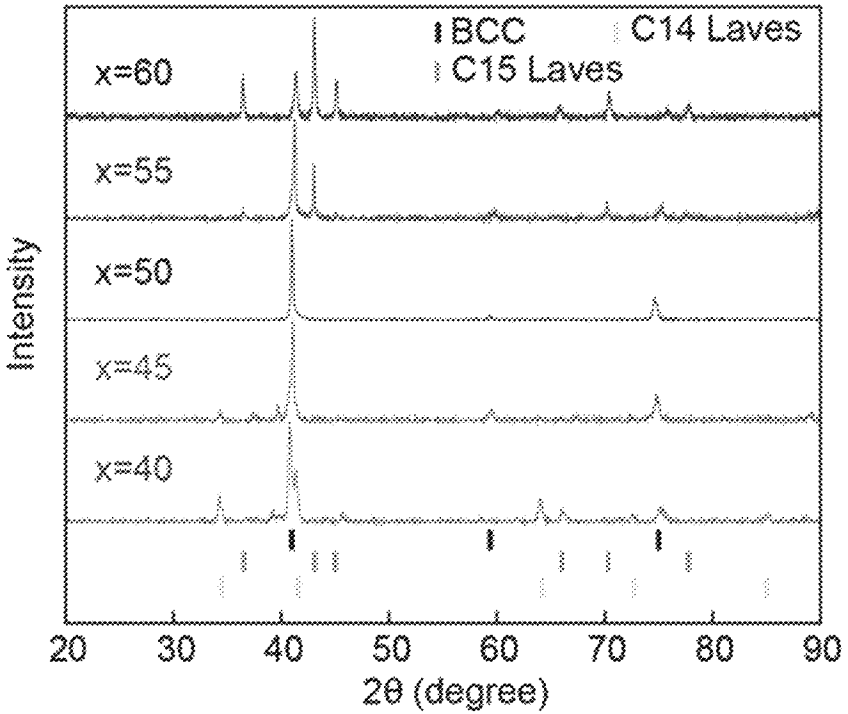
FIG. 1A shows X-ray diffraction (XRD) patterns of various $(TiZr)_{100-x}(CoNi)_x$ alloy in accordance with one embodiment of the invention.

FIG. 1A shows the XRD patterns of the five alloys. It is demonstrated that only the equiatomic TiZrCoNi alloy exhibits a single-phase random BCC structure, whereas the other four alloys exhibit complex intermetallic phases including the C14 Laves phase and/or the C15 Laves phase. As shown in FIG. 1B, TiZrCoNi has a random BCC structure in the as-cast state but an ordered B2 structure after being annealed at 1000° C. for 24 hours.

In addition, other properties of this TiZrCoNi was further analyzed, as will be discussed below. The changing elastic modulus with increasing temperature of TiZrCoNi was measured by a dynamic mechanical analyzer (Mettler DMA1 with 3-point bending mode and frequency from 0.2 Hz to 20 Hz, with the testing temperature increased from 300K to 800K at 5 K/min).

Figure 2:
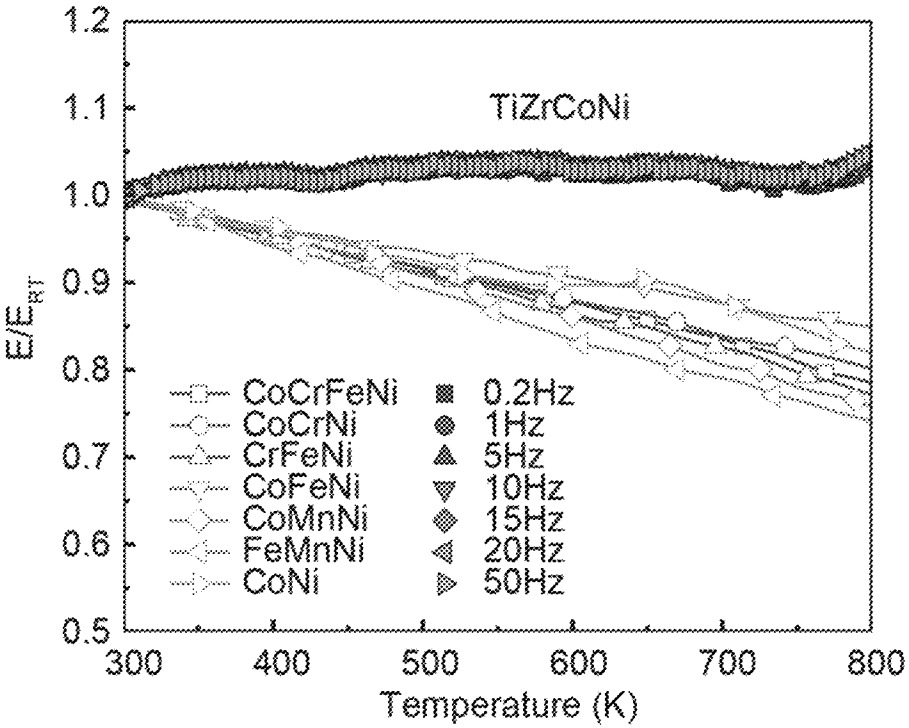
FIG. 2 is a graph of normalized elastic modulus versus temperature of TiZrCoNi and other chemically complex alloys.

FIG. 2 is a graph showing normalized elastic modulus versus temperature of TiZrCoNi and other chemically complex alloys, where ERT is the elastic modulus at room temperature. The TiZrCoNi sample with dimensions 2 mm×3 mm×25 mm was prepared by wire cutting, followed by mechanically grinding using 2500 grit sandpapers. The elastic modulus of TiZrCoNi was measured at different vibration frequencies as indicated in FIG. 2. Regardless of the temperature and the vibration frequency of 0.2 Hz, 1 Hz, 5 Hz, 10 Hz, 15 Hz, 20 Hz and 50 Hz, it is shown that TiZrCoNi exhibits a constant elastic modulus over a wide temperature range, which is in contrast to the other alloys including CoCrFeNi, CoCrNi, CrFeNi, CoFeNi, CoMnNi, FeMnNi and CoNi.

Figure 3B:
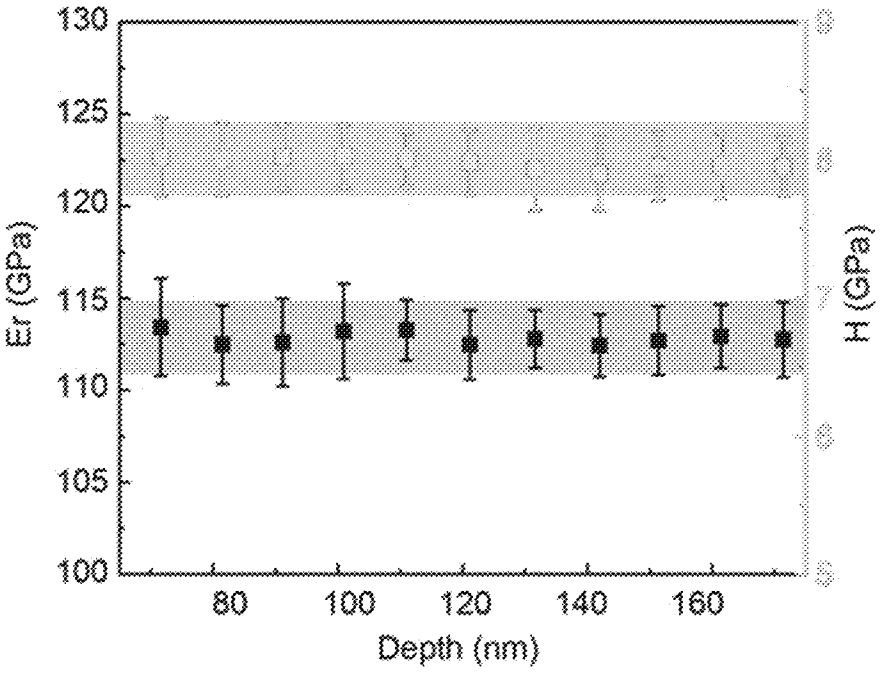
FIG. 3B is a graph showing reduced modulus and hardness versus depth of TiZrCoNi.
Figure 3A:
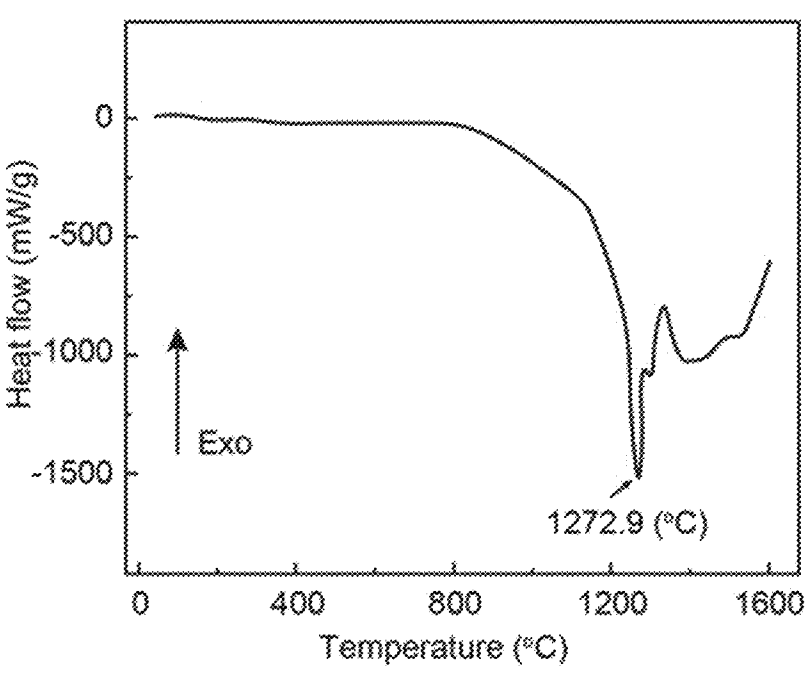
FIG. 3A is a differential thermal analysis (DTA) curve of TiZrCoNi.

FIG. 3A is a DTA curve of TiZrCoNi obtained using Themys TG-DTA, showing the melting peak at 1272.9° C. In this experiment, samples were placed in an alumina crucible and tested under an argon atmosphere. The testing temperature increased from 40° C. to 1600° C. at 10° C./min. FIG. 3B shows the relatively constant reduced modulus and hardness of TiZrCoNi obtained using Hysitron TI 950 TriboIndenter system. In this experiment, samples were mechanically ground and polished to a mirror finish. These samples were then tested by Berkovich indenter under cyclic loading (peak load increased from 0.04 mN to 8 mN in 20 cycles).

The above embodiments have provided a quaternary chemically random alloy with a strong Elinvar effect over a wide temperature range of about 250 K to about 850 K. The thermal-induced ordering contributes to the structural simplicity of the alloy. The properties of the alloy are not limited to the sample size. The alloy also exhibits excellent fluidity. The composition of the alloy and the fabrication thereof described above are also advantageous in provide a relatively low-cost and easy-to-fabricate alloy, thus devices manufactured using the alloy.

It will be appreciated by persons skilled in the art that numerous variations and/or modifications may be made to the invention as shown in the specific embodiments without departing from the spirit or scope of the invention as broadly described. The described embodiments of the invention should therefore be considered in all respects as illustrative, not restrictive.

The invention claimed is:

1. A quaternary alloy having a formula of TiZrCoNi, wherein the alloy is a substantially equiatomic alloy and is an Elinvar alloy having a relatively constant elastic modulus with varied temperature, and wherein the alloy exhibits a single-phase body-centered cubic crystalline structure with chemical randomness in the as-cast state and exhibits an ordered body-centered cubic B2 structure after being annealed.

2. The quaternary alloy of claim 1, wherein the varied temperature is in the range of 250 K to 850 K.

3. A method of fabricating the quaternary alloy of claim 1, comprising:

melting a mixture consisting essentially of, in atomic percentage,
25% of Ti,
25% of Zr,
25% of Co, and
25% of Ni; and quenching the melted mixture to form the alloy with a single-phase body-centered cubic crystalline structure with chemical randomness.

4. The method of claim 3, wherein the melting is performed in an arc furnace under an inert atmosphere.

5. The method of claim 4, wherein the inert atmosphere comprises argon.

6. The method of claim 4, wherein the inert atmosphere is provided with a getter material.

7. The method of claim 6, wherein the getter material is titanium.

8. The method of claim 3, further comprising annealing the alloy at 1000° ° C. for 24 hours to result in an ordered B2 structure.

9. The quaternary alloy of claim 1, wherein Ti, Zr, Co, and Ni each having an atomic % of 25%.

10. The quaternary alloy of claim 1, wherein the alloy has a relatively constant reduced modulus over a depth of the alloy from 70 nm to 170 nm.

11. The quaternary alloy of claim 1, wherein the alloy has a relatively constant hardness over a depth of the alloy from 70 nm to 170 nm.

* * * * *